US007246717B2

(12) United States Patent
Rodgers et al.

(10) Patent No.: US 7,246,717 B2
(45) Date of Patent: Jul. 24, 2007

(54) FIRE RESISTANT BASE TANK FOR MOUNTING A GENERATOR

(75) Inventors: Jerry W. Rodgers, Escalon, CA (US); Scott E. Buske, Tracy, CA (US)

(73) Assignee: Power Generation & Engineering, Inc., Oakdale, CA (US)

( * ) Notice: Subject to any disclaimer, the term of this patent is extended or adjusted under 35 U.S.C. 154(b) by 366 days.

(21) Appl. No.: 10/660,989

(22) Filed: Sep. 12, 2003

(65) Prior Publication Data

US 2005/0035121 A1 Feb. 17, 2005

Related U.S. Application Data

(60) Provisional application No. 60/410,869, filed on Sep. 12, 2002.

(51) Int. Cl.
*F17C 1/00* (2006.01)
*B65D 90/02* (2006.01)
*B65D 85/68* (2006.01)

(52) U.S. Cl. ..... 220/560.01; 220/565; 206/319

(58) Field of Classification Search ..... 220/560.01, 220/567.2, 652, 653, 900, 565, 62.22, 62.19; 206/319

See application file for complete search history.

(56) References Cited

U.S. PATENT DOCUMENTS 3,948,636 A * 4/1976 Marks ..... 504/318
3,995,168 A * 11/1976 Neuscheler et al. ..... 250/577
4,013,190 A 3/1977 Wiggins et al.
4,274,491 A 6/1981 Tarpley, Jr.
4,367,799 A 1/1983 Tarpley, Jr.
4,594,167 A 6/1986 Kobayashi et al.
4,989,750 A * 2/1991 McGarvey ..... 220/560.01
5,012,949 A 5/1991 McGarvey et al.
5,038,456 A 8/1991 McGarvey
5,092,024 A 3/1992 McGarvey
5,271,493 A 12/1993 Hall
5,601,204 A 2/1997 Hall
5,645,926 A 7/1997 Horrocks et al.
5,849,210 A 12/1998 Pascente et al.
5,893,479 A 4/1999 Berberat
5,960,981 A * 10/1999 Dodson et al. ..... 220/563
6,001,437 A 12/1999 Thorpe et al.

(Continued)

FOREIGN PATENT DOCUMENTS

JP 10231663 A * 9/1998

*Primary Examiner*—Anthony D. Stashick
*Assistant Examiner*—Shawn M. Braden
(74) *Attorney, Agent, or Firm*—John P. O'Banion

(57) ABSTRACT

An above-ground, double-walled, tank for holding combustible material and supporting a generator has an outer tank and an inner tank with structural baffles, all made from type 316 stainless steel. An interstitial space formed by the outer tank and inner tank is filled with a fire resistant solution consisting of a fire block gel and water. An internal support system, including structural baffles in the inner tank, provide a structure to support a generator and other equipment on the top of the tank without the use of tank wall stiffeners or external beams. A level detector in the interstitial space detects changes in the level of the fire resistant solution. A water detector in the inner tank detects the presence of water. The fire resistant solution may be removed from the interstitial space for tank inspection and repair.

29 Claims, 5 Drawing Sheets

U.S. PATENT DOCUMENTS

| | | | | |
|---|---|---|---|---|
| 6,026,975 | A | 2/2000 | Slater | |
| 6,257,437 | B1 | 7/2001 | Slater | |
| 6,349,873 | B1 | 2/2002 | Slater | |
| 6,393,786 | B1 * | 5/2002 | Hudson et al. | 52/306 |
| 6,422,413 | B1 | 7/2002 | Hall et al. | |
| 6,520,124 | B2 * | 2/2003 | Bohm, II | 123/2 |
| 6,686,003 | B2 * | 2/2004 | Legare | 428/34.4 |
| 6,874,284 | B1 * | 4/2005 | Hayward | 52/79.1 |
| 2002/0020536 | A1 | 2/2002 | Bennett | |
| 2002/0113694 | A1 | 8/2002 | Muirhead | |
| 2003/0024934 | A1 * | 2/2003 | Moore | 220/560.03 |

* cited by examiner

FIRE RESISTANT BASE TANK FOR MOUNTING A GENERATOR

CROSS-REFERENCE TO RELATED APPLICATIONS

This application claims priority from U.S. provisional application Ser. No. 60/410,869 filed on Sep. 12, 2002, incorporated herein by reference.

STATEMENT REGARDING FEDERALLY SPONSORED RESEARCH OR DEVELOPMENT

Not Applicable

INCORPORATION-BY-REFERENCE OF MATERIAL SUBMITTED ON A COMPACT DISC

Not Applicable

BACKGROUND OF THE INVENTION

1. Field of the Invention

This invention pertains generally to above ground fuel tanks for generators, and more particularly to a lightweight, low profile base tank with fire resistive, impact resistive and leak protection elements.

2. Description of Related Art

Many auxiliary generators that provide remote or backup power are mounted on a base tank as an integrated system. The base tank is required to provide sufficient fuel to the generator system to run for extended periods of time without refueling. Space for installation and access for auxiliary generators is often constrained by site features and facility design, limiting the equipment that may be used for positioning. For a given space, the dimensions and profile of the tank, along with the necessary mounting system for the generator, define the volume of fuel that may be accommodated in a base tank.

In most applications, aboveground tanks must have secondary containment to prevent fuel leaks to the environment and employ a double wall tank design. Underwriters Laboratory Inc. (UL) 142 standard (incorporated herein by reference) for steel aboveground tanks for flammable and combustible liquids is a safety standard that has been followed to construct commercially available double wall tanks for more than 14 years. A more recent UL 2085 standard for protected aboveground tanks (incorporated herein by reference) specifies limits to the heat transferred to the primary, or inner fuel tank, when exposed to a two-hour hydrocarbon pool fire. This standard further specifies a protection requirement from physical damage including projectile damage.

Commercially available base tanks constructed to the UL 2085 standard typically use a double wall metal tank with concrete, solidified foam or other solid insulating material in an interstitial space of about six inches to resist the heat of a two hour fire and provide damage and projectile protection. The fire resistant insulation is typically installed before the tank is transported to the site. Increased tank weight increases cost and complexity of installation, however. The relatively large interstitial space required for solid insulating material significantly increases the footprint of the base tank and decreases fuel volume for a given installation space.

Furthermore, once installed, solid insulating material cannot be easily removed from the interstitial space for inspection or repair.

By way of example, U.S. Pat. Nos. 6,422,413 and 5,271,493 to Hall et al., incorporated herein by reference, teach using about six inches of poured concrete as an insulator. The concrete works well as a fire shield, however, the concrete also makes the tank extremely heavy and cumbersome to transport and install. Further, once the concrete has hardened, it cannot be readily removed for tank inspection or repair.

U.S. Pat. Nos. 6,026,975, 6,257,437 and 6,349,873 to Slater, incorporated herein by reference, disclose Perlite, Vermiculite, fire retardant polymeric foam, ceramic or cementitious materials such as regular concrete, sand or a cementitious material containing a aggregate as an insulator material in the interstitial space. Slater describes a solid insulation, preferably concrete, in an interstitial space, preferably 6 inches to provide the required fire resistance and impact resistance for the UL 2085 standard. Slater does not teach a tank embodiment with an interstitial space of less than 6 inches that meets the UL 2085 standard nor the use of a non-solid fire resistant insulation in the interstitial space.

Other methods have been employed to provide fire resistance to above-ground fuel tanks. For example, U.S. Pat. Nos. 5,285,920; 5,012,949; 5,038,456 and 4,989,750 to McGarvey et al., incorporated herein by reference, describe above-ground fire resistant tanks that have a sprayed-on exterior fire resistant intumescent material such as Chartek. McGarvey further teaches a double wall tank embodiment with a solid insulation material such as Vermiculite, foamed concrete, Fendolite, Styrofoam or pumice in the double wall space. McGarvey does not, however, teach a combination of exterior fire resistant material, interstitial insulation and support structure necessary to function as a generator base tank. Furthermore, McGarvey does not teach a non-solid insulation material for the interstitial space.

Although several above-referenced patents suggest materials other than A-36 mild steel for tank walls, such as plastic, fiberglass, or corrosion resistant steel, they do not suggest any particular type of steel that would provide the combined advantage of improved heat conduction, impact resistance, and as corrosion resistance to a water base fire resistant solution in the interstitial space. In fact, the corrosion resistant steels described do not exhibit those properties.

Furthermore, in order to support a generator on the top of a base tank, there must be a support structure extending from the equipment pad, to the mounts of the generator on the tank. For example, U.S. Pat. Nos. 6,026,975, 6,257,437 and 6,349,873 to Slater, incorporated herein by reference, disclose stiffening members for the top and bottom walls of the inner tank, top and side walls of the outer tank, and support beams along the top outer tank wall. These stiffening members provide support for the generator, however this external support configuration adds significant weight and size to the tank system and can interfere with generator maintenance access.

Therefore, there is a need for a lightweight low-profile base tank designed to meet the UL 2085 standard and support commercially available generators. Further, the capability to install a fire resistant material in the interstitial space after tank installation and inspect and repair the tank without dismantling is highly beneficial to overcome shortcomings of bulkier and heavier generator base tanks.

BRIEF SUMMARY OF THE INVENTION

The present invention satisfied the foregoing needs and overcomes deficiencies in previously developed tanks by providing, according to one aspect of the invention, a lightweight base tank for a generator system comprising an outer tank of type 316 stainless steel and an inner tank of type 316 stainless steel with structural baffles in the inner tank. In one embodiment, the outer tank and inner tank are structurally coupled to form a relative small interstitial space. An intumescent fire resistant coating impregnated with a thermal resistant fiberglass mesh is placed on the outside of the outer tank. After the tank is installed, the interstitial space between the inner tank and outer tank is filled with a fire resistant solution.

The inventive combination of a type 316 double wall steel tank with an outer intumescent fire resistant coating coupled with a fire resistant solution in the interstitial space exhibits sufficient fire resistance to meet the UL 2085 standard. The physical properties of the type 316 stainless steel combined with the fire resistant solution in the interstitial space also exhibit sufficient resistance to physical and projectile damage to meet the UL 2085 standard.

In one embodiment, generator mounts on the top of the outer tank are supported in part by structural baffles in the inner tank and interstitial spacers between the inner tank and outer tank. No external columns, beams or stiffeners are necessary to support a generator.

The fire resistant solution can be removed for inspection or repair of the tank at the site. A leak detection system with a level sensor is located in the interstitial space and can detect a leak in the outer tank or in the inner tank. A water detection system may also be located in the inner tank to detect leaks. An antifreeze solution is optionally added to the fire resistant solution to protect the solution from freezing in cold climates.

One aspect of the invention is a light weight base tank for a generator using type 316 stainless steel for the walls of the inner tank and the walls of the outer tank. In one mode of this aspect, the thickness of the outer tank walls is about one-quarter inch. In another mode of this aspect, the thickness of the inner tank walls is about three-sixteenths of an inch.

Another aspect is a base tank having type 316 stainless steel for tank walls for beneficial heat conductance, projectile resistance and corrosion resistance.

A further aspect is a base tank with baffles configured in an inner tank for heat conduction and internal support. In one mode of this aspect, the baffles are made of type 316 stainless steel. In another mode, the baffles couple opposite side walls of the inner tank and couple the top wall and bottom wall of the inner tank.

Another aspect is a base tank with a coating of intumescent paint on the outer tank. In one mode of this aspect, a thermal resistant fiberglass mesh is embedded in the coating of intumescent paint. In another mode the intumescent paint is Thermolag 3000™.

A further aspect is a base tank with an interstitial space between the inner tank and the outer tank of about two inches or less for side and bottom walls and about four inches or less for top walls. In beneficial mode of this aspect, the interstitial space between the side walls and bottom walls of the inner tank and the outer tank is about one inch.

A still further aspect is a lightweight low profile base tank that meets the UL 2085 standard.

Another aspect is a base tank with a fire resistant solution installed in the interstitial space between the inner tank and the outer tank. In one mode of this aspect, the fire resistant solution is installed after the base tank is in place. In another mode, the fire resistant solution can be removed to inspect or repair the base tank while the base tank remains in place. In a further mode, the base tank can be put back in service after a fire by replacing the fire resistant solution.

A further aspect is a fire resistant solution consisting of at least two percent fire blocking gel and at least eighty-eight percent water. In one mode, the fire resistant solution is BARRICADE™. In another mode, the fire resistant solution can be modified to prevent freezing during cold temperatures. In a further mode, the fire resistant solution contains up to ten percent propylene glycol to prevent freezing.

Another aspect is a lightweight low profile base tank with an internal support structure that includes baffles in the inner tank. In one mode of this aspect, a plurality of generator mounts are coupled directly to the top of the outer tank with no external support beams. In another mode, tubular generator supports couple the top of the inner tank to the top of the outer tank and align with the baffles in the inner tank and the generator mounts on top of the outer tank A further aspect is a base tank with a leak detection system with a level sensor in the interstitial space to detect loss of a fire resistant solution.

A still further aspect is a base tank with a water detection system in the inner tank to detect water, or a solution containing water, leaking into the inner tank from the interstitial space.

Further aspects of the invention will be brought out in the following portions of the specification, wherein the detailed description is for the purpose of fully disclosing preferred embodiments of the invention without placing limitations thereon.

BRIEF DESCRIPTION OF THE SEVERAL VIEWS OF THE DRAWING(S)

The invention will be more fully understood by reference to the following drawings which are for illustrative purposes only:

DETAILED DESCRIPTION OF THE INVENTION

Referring more specifically to the drawings, for illustrative purposes the present invention is embodied in the apparatus generally shown in FIG. 1 through FIG. 5. It will be appreciated that the apparatus may vary as to configuration and as to details of the parts, and that the method may vary as to the specific steps and sequence, without departing from the basic concepts as disclosed herein. All joints are typically made with welds unless otherwise specified.

Figure 1:
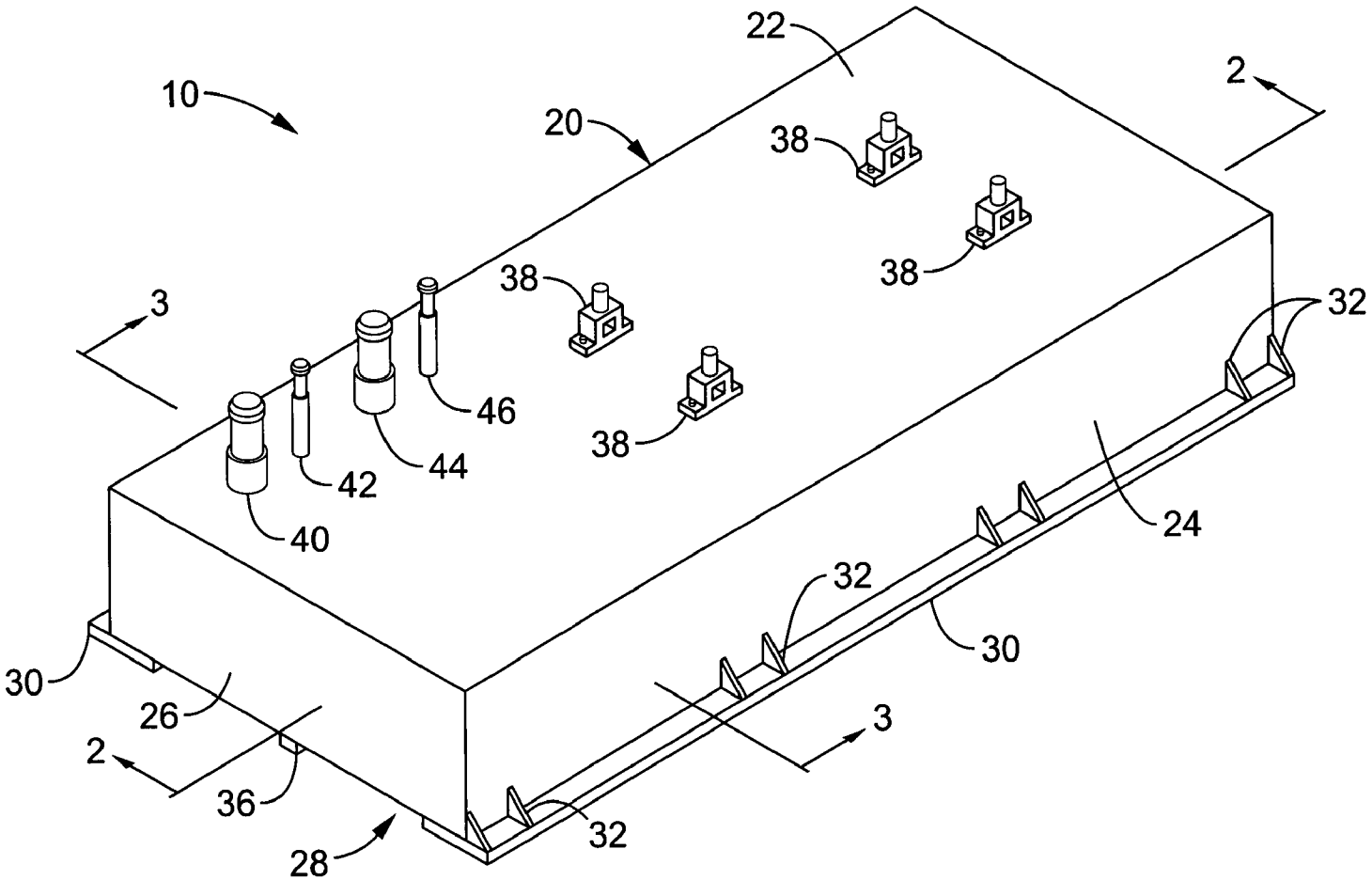
FIG. 1 is a perspective view of the exterior of a base tank for a generator according to the present invention.

FIG. 1 is a perspective view of the exterior of a fire resistant base tank assembly 10 before a fire resistant coating (shown in FIG. 2 and FIG. 3) is applied. Details of tank components such as ports for instrumentation, fuel supply, fuel return and venting, brackets for lifting and securing, and tank cut outs for electrical connections, as are known in the art, are omitted for clarity. Base tank assembly 10 comprises an outer tank 20 and an inner tank 50 which are positioned and configured as will be more fully described below.

Outer tank 20 has a top wall 22, two side walls 24, two end walls 26, and a bottom wall 28. Outer tank 20 is preferably made from type 316 stainless steel or equivalent and, in a particular embodiment, the walls are one-quarter inch thick. A pair of base members 30, coupled to side walls 24, are provided to support tank 10 when it is placed on an equipment pad (not shown). Base members 30 preferably have reinforcement tabs 32 coupled to side walls 24. In one embodiment, base members 30 and reinforcement tabs 32 are made from one-half inch stainless steel. A center support 36, extending between end walls 26, is coupled to the outside of bottom wall 28 and centered between base members 30 to provide further support to bottom wall 28 on the equipment pad. In one particular embodiment, center support 36 is one-half inch thick stainless steel. A plurality of generator mounts 38 are coupled to top wall 22 and are shown in further detail in FIG. 2 through FIG. 4.

Figure 2:
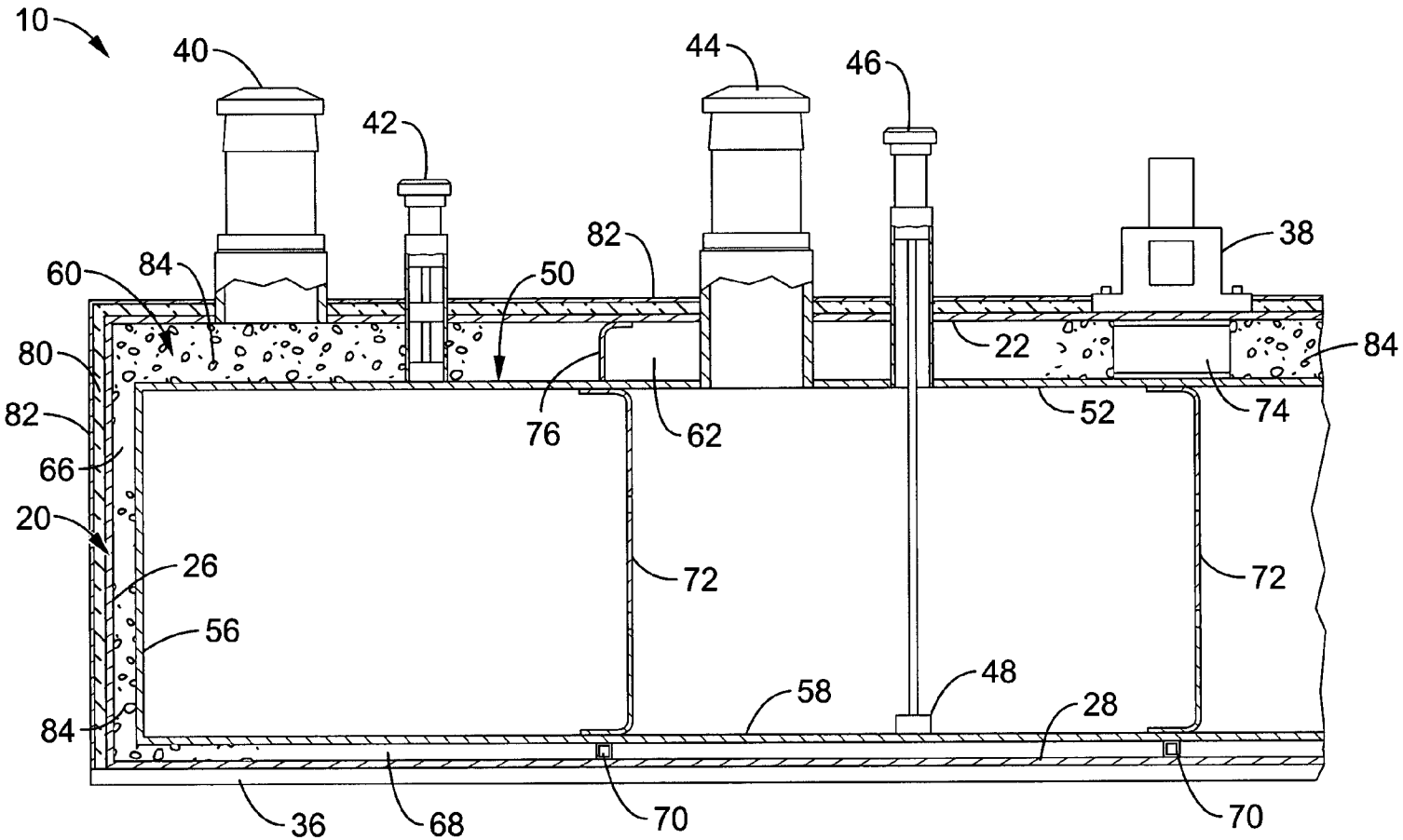
FIG. 2 is a partial cross-section view of the base tank shown in FIG. 1 taken through lines 2-2.
Figure 3:
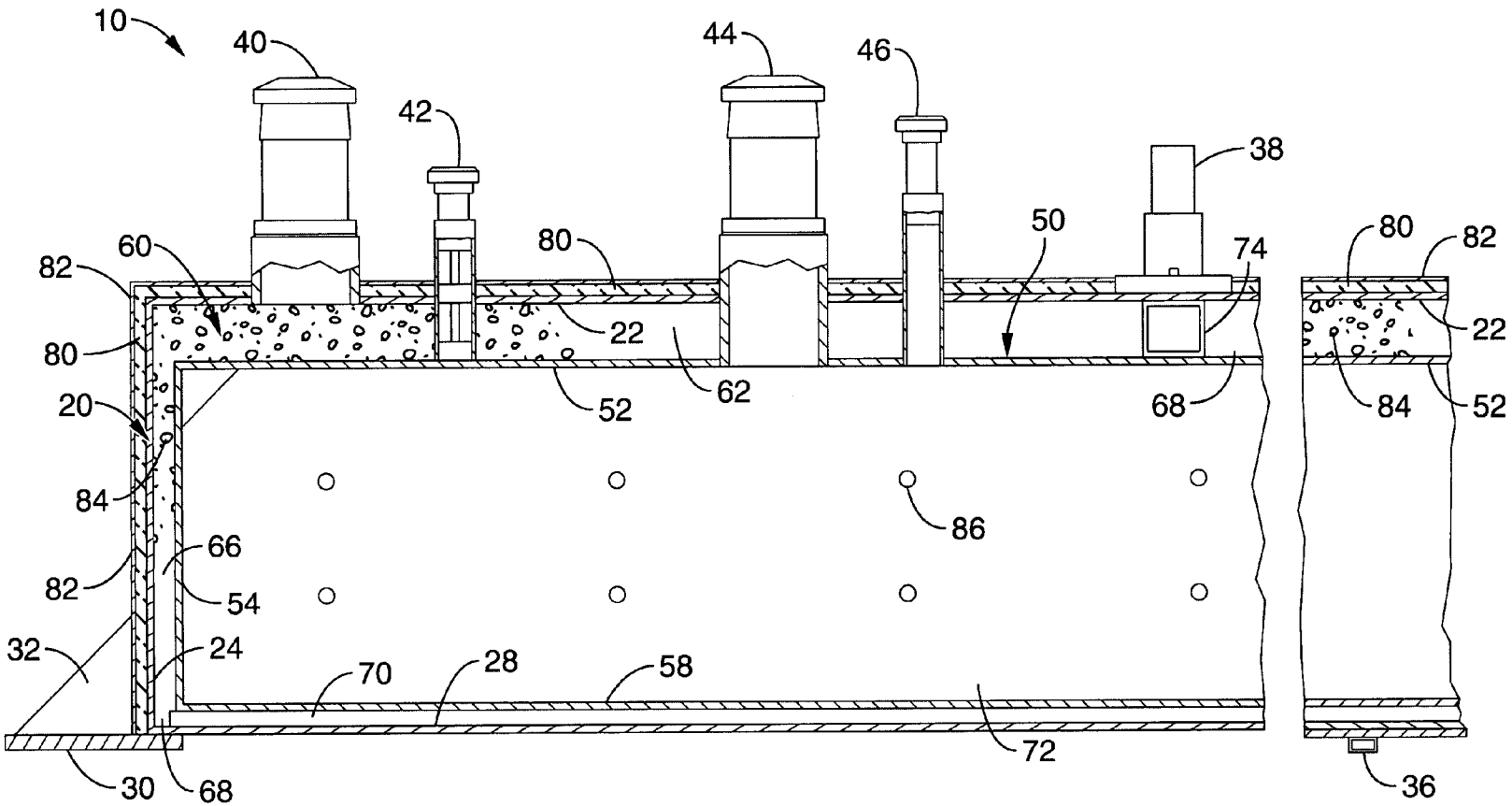
FIG. 3 is partial cross-section view of the base tank shown in FIG. 1 taken through lines 3-3.

An access port 40, level detector 42, fuel port 44, and water detector 46 are also provided as will be described further with reference to FIG. 2 and FIG. 3. FIG. 2 is a partial side sectional view of the base tank assembly 10 in FIG. 1, and FIG. 3 is a partial end sectional view of the base tank assembly 10 in FIG. 1. Access port 40, level detector 42, fuel port 44 and water detector 46 are repositioned in these views for clarity.

Inner tank 50 has a top wall 52, two side walls 54, two end walls 56 and a bottom wall 58. Inner tank 50 is preferably made of type 316 stainless steel or equivalent and, in a particular embodiment, is three-sixteenths inches thick. Inner tank 50 is fluidly connected to one or more fuel ports 44 which can be used for filling, venting, fuel supply, fuel return or measurement. Water detector 46 has a sensor 48 positioned in inner tank 50 adjacent bottom wall 58 to detect the presence of water.

Inner tank 50 is positioned within outer tank 20 to form an interstitial space 60 which is fluidly connected to access port 40. Interstitial space 60 has a top space 62 defined by top walls 22 and 52, two side spaces 64 defined by side walls 24 and 54, two end spaces 66 defined by end walls 26 and 56, and a bottom space 68 defined by bottom walls 28 and 58. In one mode, top space 62 is at least about four inches between top wall 22 and top wall 52, side spaces 64 are about one to two inches between side walls 24 and 54, end spaces 66 are one to two inches between end walls 26 and 56, and bottom space 68 is about one to two inches between bottom walls 28 and 58. In the preferred embodiment, side spaces 64, end spaces 66 and bottom space 68 are about one inch between walls.

One or more access ports 40 are fluidly connected to interstitial space 60 and can be used for filling, venting, measurement or removal of a fluid. Level detector 42 is fluidly connected to interstitial space 60 and detects a change in level of a fluid in interstitial space 60.

The bottom wall 58 of inner tank 50 is supported by and coupled to bottom wall 28 of outer tank 20 by spacer tube 70. Spacer tube 70 is preferably made of type 316 stainless steel or equivalent and extends the width of end walls 56 of inner tank 50. In one particular embodiment, spacer tube 70 is one inch by one inch box tubing. Other spacers with cross sections as channels, angles or hats, as are known in the art, may also be used.

The top wall 52 of inner tank 50 is supported by and coupled to bottom wall 58 of inner tank 50 by tank baffles 72 having one or more holes 86 therethrough for fuel flow. Tank baffles 72 also couple the side walls 54 of inner tank 50. Tank baffles 72 are spaced as necessary for support, but preferably not greater than approximately twenty-four inches apart and are structurally aligned with spacer tubes 70. Tank baffles 72 are preferably made of type 316 stainless steel or equivalent.

The top wall 22 of outer tank 20 is supported in part by, and coupled to, top wall 52 of inner tank 50 by a plurality of tubular generator supports 74. Tubular generator supports 74 are positioned to support generator mounts 38 and are structurally aligned with one or more baffles 72. Tubular generator supports 74 may also be used to support top wall 22 in locations not associated with generator mounts 38. In one beneficial embodiment, tubular generator supports 74 are an eight inch by eight inch box tubing of one-quarter inch thick plate stainless steel about four inches long.

Figure 5:
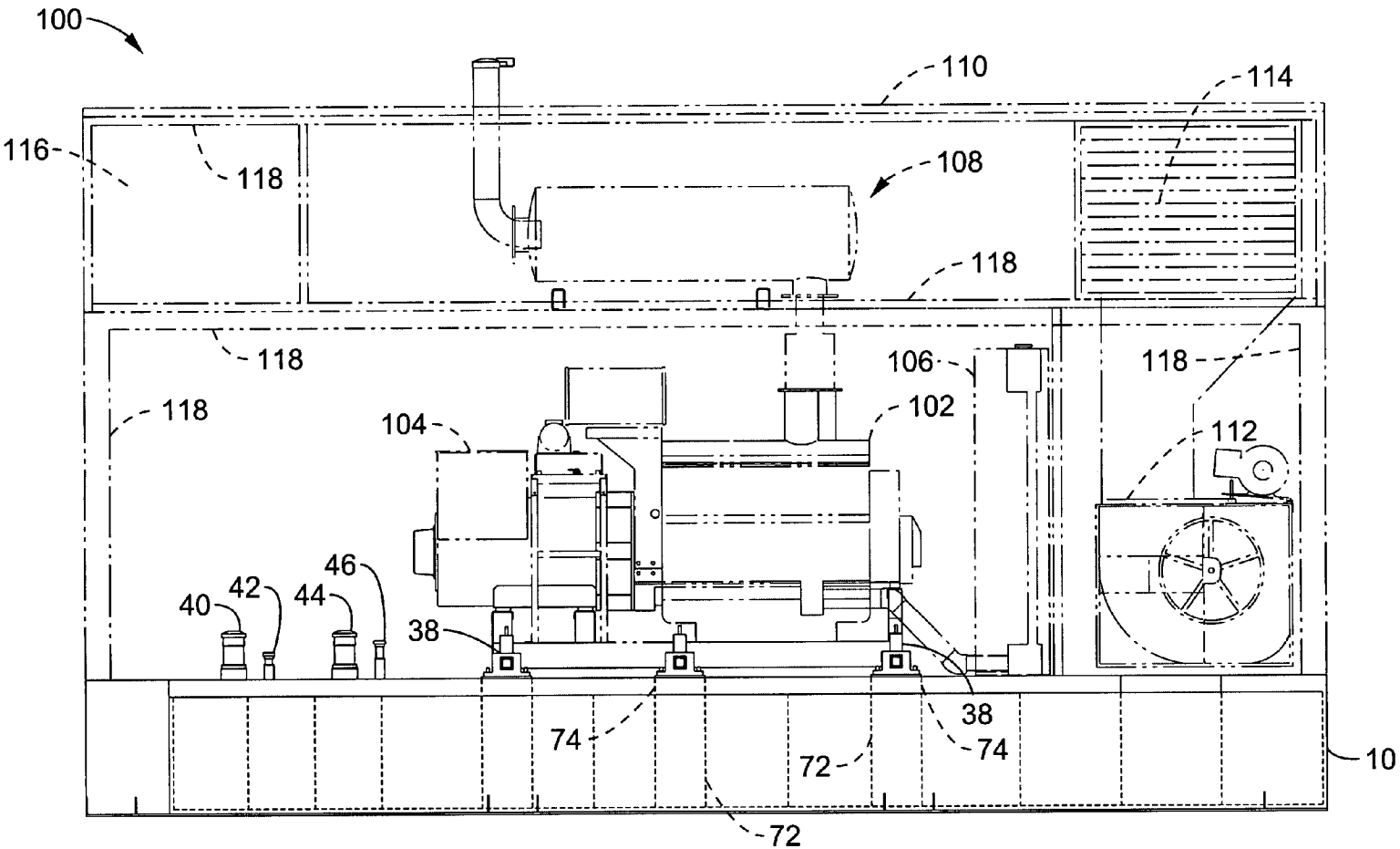
FIG. 5 is side view of a base tank according to the present invention shown with a generator, related components, and enclosure mounted on top shown in phantom.

A generator system (as shown in FIG. 5) can be supported on tank assembly 10 without external columns, stiffening members or beams by the beneficial configuration and coupling of base elements 30, center support 36, bottom wall 28, spacer tubes 70, bottom wall 58, tank baffles 72, top wall 52 tubular generator supports 74, top wall 22 and generator mounts 38.

Top wall 22 of outer tank 20 is also supported in part by an interstitial baffle 76 that couples top wall 22 of outer tank 20 to top wall 52 of inner tank 50 and is further aligned with a tank baffle 72. Interstitial baffle 76 typically couples to side walls 24 and is adapted with openings (not shown) for the flow of fluid. In a beneficial embodiment, interstitial baffle 76 is made of one-quarter inch stainless steel or the like. In one beneficial embodiment, there is at least one interstitial baffle 76 for each pair of generator mounts 38.

The outside surface of top wall 22, side walls 24, and end walls 26 of outer tank 20 are covered by a layer of fire resistant fiberglass mesh 80. The fiberglass mesh 80 is in turn covered by a coat of intumenscent paint 82. In one particular method of installation, a first coat of intumescent paint 82 is applied to the walls of tank 20. The fiberglass mesh 80 is applied while the first coat of intumescent paint 82 is still wet. A second coat of intumenscent paint 82 is the applied over fiberglass mesh 80, effectively embedding the fiberglass mesh 80 within a thick coating of intumescent paint 82. In a preferred embodiment, the intumescent paint 82 is Thermolag 3000™. In a preferred embodiment, the thickness of the fiberglass mesh 80 with the intumescent paint 82 on the outside walls of tank 20 is about one-eight inch.

Interstitial space 60, defined by the opposing walls of outer tank 20 and inner tank 50, is filled with a fire resistant solution 84 through an access port 40, preferably after site installation of tank assembly 10. Fire resistant solution 84 comprises, in part, a compound that will significantly reduce the movement of a fluid, such as water, by convection when exposed to heat. A fire block gel, such as BARRICADE™, exhibits this property. Fire resistant solution 84 preferably comprises at least two percent fire block gel mixed with at least about eighty-eight percent water. Up to about ten percent propylene glycol may be added to fire resistant solution 84 to provide freeze protection.

The specific use of type 316 stainless steel for outer tank 20, coated with fire resistant fiberglass mesh 80 and intumescent paint 82, combined with fire resistant solution 84 in interstitial space 60 and the use of type 316 stainless steel for inner tank 50 and tank baffles 72, results in base tank 10 having a two-hour fire rating and resisting physical damage sufficient to meet the UL 2085 standard.

Figure 4:
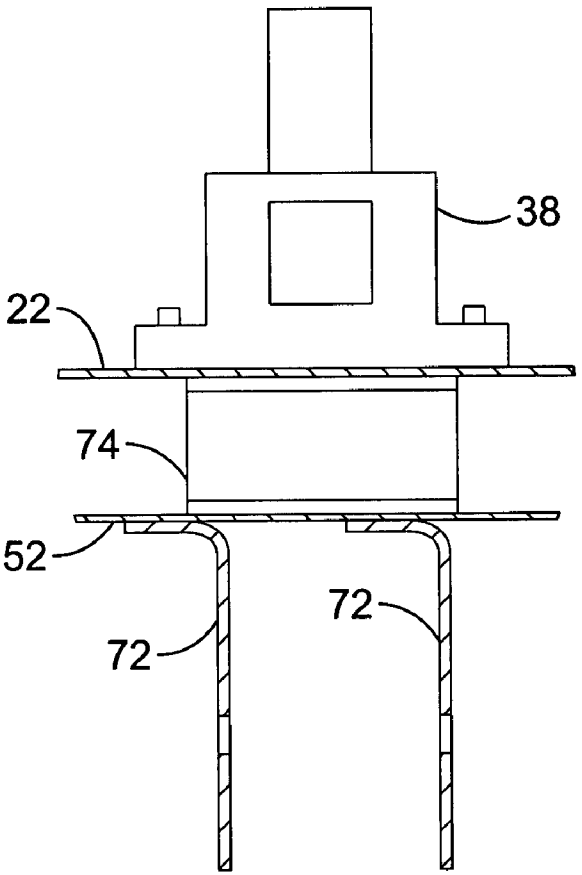
FIG. 4 is a side view of an alternative embodiment of the generator mount configuration shown in FIG. 1, wherein two baffles are employed.

Referring now to FIG. 4, an alternative embodiment of a support configuration for a generator mount 38 is shown. In this embodiment, a pair of baffles 72 are coupled to top wall 52 and aligned to provide support to tubular generator support 74 coupled to top wall 52. In this way, additional structural support for generator mount 38 is provided through top wall 22.

FIG. 5 illustrates a generator system 100 mounted on a base tank assembly 10 with generator mounts 38 and without external brackets, beams or stiffeners. Connections, controls, panels and relief valves, known in the art, have been omitted for clarity. Alignment of baffles 72 and alignment of tubular generator supports 74, are illustrated for the particular mounting configuration shown. Generator system 100 includes a motor 102, a generator 104, a radiator 106, and an exhaust system 108, shown partially in phantom. In this embodiment, an optional enclosure 110 is also supported by base tank assembly 10 without external brackets, beams or stiffeners. Enclosure doors and panels have been omitted for clarity. Enclosure 110 includes an exhaust fan 112, an exhaust vent 114 and an air intake 116. Enclosure 110 is preferably lined with a soundproofing material 118, shown in phantom, for sound attenuation.

As can be seen, therefore, the present invention comprises a base tank for storing flammable and combustible liquids and supporting a generator. In the preferred embodiment, the base tank has an inner tank and outer tank. A plurality of baffles couple opposing side walls of the inner tank and further couple the bottom wall of the inner tank to the top wall of the inner tank. The inner tank is positioned in relation to the outer tank such that an interstitial space is defined between said walls of said outer tank and said walls of said inner tank, which is filled with a fire resistant solution. Preferably the fire resistant solution comprises at least about 2 percent fire blocking gel, such as BARRACADE™, and at least about 88 percent water. More preferably, the fire resistant solution comprises up to about 10 percent propylene glycol. Also, the walls of the inner and outer tanks are preferably fabricated from type 316 stainless steel having a thickness at least about 3/16 inch.

The walls of the outer tank are preferably coated or covered with a fire resistant material. Preferably, the fire resistant material comprises fire resistant fiberglass mesh coated with an intumescent paint, and more preferably, the intumescent paint comprises a $1/8^{th}$ inch coating of Thermolag 3000™.

In a further preferred embodiment, the interstitial space adjoining said sidewalls of said inner tank and adjoining said bottom wall of said inner tank is about 2 inches or less, and the interstitial space adjoining said top wall of said inner tank is about 4 inches or less. More preferably, the interstitial space adjoining said sidewalls of said inner tank and adjoining said bottom wall of said inner tank is about 1 inch.

Optionally, the base tank can include means for supporting a generator. Preferably, said means comprises (i) a plurality of base support members adapted to couple the bottom wall of the outer tank to an equipment pad and further adapted to support the weight of said base tank and a generator, (ii) a plurality of interstitial spacers configured to support the bottom wall of the inner tank on the bottom wall of the outer tank where the interstitial spacers are structurally coupled to the base support members and further adapted to support the weight of said inner tank and a generator, (iii) where the baffles in the inner tank are structurally coupled to the interstitial spacers and where the baffles are further adapted to support the weight of a generator, (iv) a plurality of tubular generator supports adapted to couple the top wall of the inner tank to the top wall of the outer tank in the interstitial space, (v) wherein the tubular generator supports are structurally aligned with the baffles and further adapted to support the weight of a generator, and (vi) a plurality of generator mounts coupled to the top wall of the outer tank, where the generator mounts are structurally coupled to the tubular generator supports and the generator mounts are further adapted to support the weight of a generator. Preferably, the baffles are spaced apart at a spacing of about 24 inches or less.

As a further option, a level detector configured to detect change of level of the fire resistant solution in the interstitial space can be included. Another optional aspect of the invention is a water detector configured to detect the presence of water in the inner tank.

Although the description above contains many details, these should not be construed as limiting the scope of the invention but as merely providing illustrations of some of the presently preferred embodiments of this invention. Therefore, it will be appreciated that the scope of the present invention fully encompasses other embodiments which may become obvious to those skilled in the art, and that the scope of the present invention is accordingly to be limited by nothing other than the appended claims, in which reference to an element in the singular is not intended to mean "one and only one" unless explicitly so stated, but rather "one or more." All structural, chemical, and functional equivalents to the elements of the above-described preferred embodiment that are known to those of ordinary skill in the art are expressly incorporated herein by reference and are intended to be encompassed by the present claims. Moreover, it is not necessary for a device or method to address each and every problem sought to be solved by the present invention, for it to be encompassed by the present claims. Furthermore, no element, component, or method step in the present disclosure is intended to be dedicated to the public regardless of whether the element, component, or method step is explicitly recited in the claims. No claim element herein is to be construed under the provisions of 35 U.S.C. 112, sixth paragraph, unless the element is expressly recited using the phrase "means for."

What is claimed is:

1. A base tank for storing flammable and combustible liquids and supporting a generator comprising:

an inner tank, said inner tank having side walls, a top wall and a bottom wall;

a plurality of planar baffles coupling opposing side walls of said inner tank and further coupling said bottom wall of said inner tank to said top wall of said inner tank;

an outer tank having side walls, a top wall and a bottom wall, said outer tank coupled to said inner tank;

a fire resistant material disposed on the outside of said walls of said outer tank;

wherein an interstitial space is defined between said walls of said outer tank and said walls of said inner tank;

a fire resistant solution disposed in said interstitial space;

wherein said fire resistant solution comprises at least about 2 percent fire blocking gel and at least about 88 percent water; and means for supporting a generator on said top wall of said outer tank.

2. A base tank for storing flammable and combustible liquids and supporting a generator comprising:

an inner tank, said inner tank having side walls, a top wall and a bottom wall;

a plurality of planar baffles coupling opposing side walls of said inner tank and further coupling said bottom wall of said inner tank to said top wall of said inner tank;

an outer tank having side walls, a top wall and a bottom wall, said outer tank coupled to said inner tank;

a fire resistant material disposed on the outside of said walls of said outer tank;

wherein an interstitial space is defined between said walls of said outer tank and said walls of said inner tank;

a fire resistant solution disposed in said interstitial space; and means for supporting a generator on said top wall of said outer tank;

wherein said means for supporting a generator comprises;

a plurality of base support members adapted to couple said bottom wall of said outer tank to an equipment pad, said base support members further adapted to support the weight of a base tank and a generator;

a plurality of interstitial spacers configured to support said bottom wall of said inner tank on said bottom wall of said outer tank, said interstitial spacers structurally coupled to said base support members and further adapted to support the weight of said inner tank and a generator;

said baffles in said inner tank structurally coupled to said interstitial spacers and said baffles further adapted to support the weight of a generator;

a plurality of tubular generator supports, adapted to couple said top wall of said inner tank to said top wall of said outer tank in said interstitial space;

wherein said tubular generator supports are structurally aligned with said baffles and further adapted to support the weight of a generator; and a plurality of generator mounts, said generator mounts coupled to the top wall of said outer tank;

said generator mounts structurally coupled to said tubular generator supports;

said generator mounts further adapted to support the weight of a generator.

3. A base tank as recited in claim 1 or 2, wherein said walls of said inner tank comprise type 316 stainless steel having a thickness at least about 3/16 inch.

4. A base tank as recited in claim 1 or 2, wherein said walls of said outer tank comprise type 316 stainless steel having a thickness at least about ¼ inch.

5. A base tank as recited in claim 1 or 2, wherein said fire resistant solution comprises up to about 10 percent propylene glycol.

6. A base tank as recited in claim 1 or 2:

wherein said interstitial space adjoining said sidewalls of said inner tank and adjoining said bottom wall of said inner tank is about 1 inch to about less than 2 inches.

7. A base tank as recited in claim 2, wherein said baffles are spaced apart at a spacing of about 24 inches or less.

8. A base tank as recited in claim 1 or 2, further comprising a level detector configured to detect change of level of said fire resistant solution in said interstitial space.

9. A base tank as recited in claim 1 or 2, further comprising a water detector configured to detect the presence of water in said inner tank.

10. A base tank as recited in claim 1 or 9, wherein said fire resistant coating on said outer tank further comprises a fire resistant fiberglass mesh coated with an intumescent paint.

11. A base tank as recited in claim 10, wherein said intumescent paint comprises a ⅛th inch coating.

12. A base tank for storing flammable and combustible liquids and supporting a generator comprising:

an inner tank, said inner tank having side walls, a top wall and a bottom wall;

said walls of said inner tank comprising type 316 stainless steel of at least about 3/16 inch thickness;

a plurality of planar baffles coupling opposing side walls of said inner tank and further coupling said bottom wall of said inner tank to said top wall of said inner tank;

an outer tank having side walls, a top wall and a bottom wall, said outer tank coupled to said inner tank;

said walls of said outer tank comprising type 316 stainless steel of at least about ¼ inch thickness;

a fire resistant fiberglass mesh disposed over the outside of said walls of said outer tank;

an intumescent paint coating disposed over said fire resistant fiberglass mesh;

wherein an interstitial space is defined between said walls of said outer tank and said walls of said inner tank;

wherein said interstitial space adjoining said sidewalls of said inner tank and adjoining said bottom wall of said inner tank is about 2 inches or less;

wherein said interstitial space adjacent said top wall of said inner tank is about 4 inches;

a fire resistant solution disposed in said interstitial space, said fire resistant solution comprising at least 2 percent fire blocking gel and at least 88 percent water;

a level detector, configured to detect a change in level of said fire resistant solution in said interstitial space;

a water detector configured to detect the presence of water in said inner tank; and means for supporting a generator on said top wall of said outer tank.

13. A base tank as recited in claim 12, wherein said means for supporting a generator comprises:

a plurality of base support members configured to attach said bottom wall of said outer tank to an equipment pad, said base support members further adapted to support the weight of a base tank and a generator;

a plurality of interstitial spacers configured to support said bottom wall of said inner tank on said bottom wall of said outer tank, said interstitial spacers structurally coupled to said base support members and further adapted to support the weight of said inner tank and a generator;

said baffles in said inner tank structurally coupled to said interstitial spacers and said baffles further adapted to support the weight of a generator;

a plurality of tubular supports adapted to couple said top wall of said inner tank to said top wall of said outer tank in said interstitial space;

wherein said tubular supports are structurally aligned with said baffles and further adapted to support the weight of a generator; and a plurality of generator mounts, said generator mounts coupled to the top wall of said outer tank;

said generator mounts structurally coupled to said tubular supports;

said generator mounts further adapted to support the weight of a generator.

14. A base tank as recited in claim 12, wherein said baffles are spaced apart at a spacing of about 24 inches or less.

15. A base tank as recited in claim 12, wherein said intumescent paint comprises a ⅛th inch coating.

16. A base tank as recited in claim 12, wherein said fire resistant solution further comprises up to about 10 percent propylene glycol.

17. A base tank for storing flammable and combustible liquids and supporting a generator comprising:

an inner tank, said inner tank having side walls, a top wall and a bottom wall;

a plurality of planar baffles coupling opposing side walls of said inner tank and further coupling said bottom wall of said inner tank to said top wall of said inner tank;

an outer tank having side walls, a top wall and a bottom wall, said outer tank coupled to said inner tank;

a fire resistant material disposed on the outside of said walls of said outer tank;

wherein an interstitial space is defined between said walls of said outer tank and said walls of said inner tank; and a fire resistant solution disposed in said interstitial space;

wherein said fire resistant solution remains liquid and is removable from said interstitial space in liquid form;

wherein said interstitial space adjoining said sidewalls of said inner tank and adjoining said bottom wall of said inner tank is about 1 inch to about less than 2 inches.

18. A base tank for storing flammable and combustible liquids and supporting a generator comprising:

an inner tank, said inner tank having side walls, a top wall and a bottom wall;

a plurality of planar baffles coupling opposing side walls of said inner tank and further coupling said bottom wall of said inner tank to said top wall of said inner tank;

an outer tank having side walls, a top wall and a bottom wall, said outer tank coupled to said inner tank;

a fire resistant material disposed on the outside of said walls of said outer tank;

wherein an interstitial space is defined between said walls of said outer tank and said walls of said inner tank;

a fire resistant solution disposed in said interstitial space;

a plurality of base support members adapted to couple said bottom wall of said outer tank to an equipment pad, said base support members further adapted to support the weight of said base tank and a generator;

a plurality of interstitial spacers configured to support said bottom wall of said inner tank on said bottom wall of said outer tank, said interstitial spacers structurally coupled to said base support members and further adapted to support the weight of said inner tank and a generator;

said baffles in said inner tank structurally coupled to said interstitial spacers and said baffles further adapted to support the weight of a generator;

a plurality of tubular generator supports, adapted to couple said top wall of said inner tank to said top wall of said outer tank in said interstitial space;

wherein said tubular generator supports are structurally aligned with said baffles and further adapted to support the weight of a generator; and a plurality of generator mounts, said generator mounts coupled to the top wall of said outer tank;

said generator mounts structurally coupled to said tubular generator supports; said generator mounts further adapted to support the weight of a generator.

19. A base tank as recited in claim 17 or 18, wherein said walls of said inner tank comprise type 316 stainless steel having a thickness at least about 3/16 inch.

20. A base tank as recited in claim 17 or 18, wherein said walls of said outer tank comprise type 316 stainless steel having a thickness at least about 1/4 inch.

21. A base tank as recited in claim 17 or 18, wherein said fire resistant solution comprises at least about 2 percent fire blocking gel and at least about 88 percent water.

22. A base tank as recited in claim 21, wherein said fire resistant solution comprises up to about 10 percent propylene glycol.

23. A base tank as recited in claim 18, wherein said baffles are spaced apart at a spacing of about 24 inches or less.

24. A base tank as recited in claim 17 or 18, further comprising a level detector configured to detect change of level of said fire resistant solution in said interstitial space.

25. A base tank as recited in claim 17 or 18, further comprising a water detector configured to detect the presence of water in said inner tank.

26. A base tank as recited in claim 17 or 18, wherein said fire resistant coating on said outer tank further comprises a fire resistant fiberglass mesh coated with an intumescent paint.

27. A base tank as recited in claim 26, wherein said intumescent paint comprises a 1/8th inch coating.

28. A base tank as recited in claim 12, wherein said fire resistant solution remains liquid and is removable from said interstitial space in liquid form.

29. A base tank as recited in claim 1, 2 or 18, wherein said fire resistant solution remains liquid and is removable from said interstitial space in liquid form.

* * * * *